US008616924B2

(12) United States Patent
Ishida

(10) Patent No.: US 8,616,924 B2
(45) Date of Patent: Dec. 31, 2013

(54) FEMALE TERMINAL FOR CONNECTOR

(75) Inventor: Keiko Ishida, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/559,699

(22) Filed: Jul. 27, 2012

(65) Prior Publication Data

US 2012/0289100 A1 Nov. 15, 2012

Related U.S. Application Data

(63) Continuation of application No. PCT/JP2011/052443, filed on Feb. 4, 2011.

(30) Foreign Application Priority Data

Feb. 4, 2010 (JP) ..... 2010-022858

(51) Int. Cl.
*H01R 11/22* (2006.01)

(52) U.S. Cl.
USPC ..... 439/851

(58) Field of Classification Search
USPC ..... 439/842–851
See application file for complete search history.

(56) References Cited

U.S. PATENT DOCUMENTS

| | | | | |
|---|---|---|---|---|
| 3,406,376 | A | 10/1968 | Varrin | |
| 4,921,456 | A | 5/1990 | French | |
| 5,147,230 | A | 9/1992 | Plyler et al. | |
| 5,720,634 | A * | 2/1998 | Sten | 439/843 |
| 5,775,960 | A | 7/1998 | Saito et al. | |
| 6,116,970 | A | 9/2000 | Yamamoto et al. | |
| 6,152,787 | A * | 11/2000 | Serbin et al. | 439/852 |
| 6,217,394 | B1 | 4/2001 | Sugie | |
| 7,249,983 | B2 * | 7/2007 | Meyer et al. | 439/878 |
| 7,438,608 | B2 * | 10/2008 | Hung | 439/851 |
| 2006/0264124 | A1 | 11/2006 | Meyer et al. | |

FOREIGN PATENT DOCUMENTS

| | | | |
|---|---|---|---|
| EP | 0 352 967 | A1 | 1/1990 |
| EP | 1962385 | A2 | 8/2008 |
| JP | 04-61773 | U | 5/1992 |
| JP | 04-102167 | U | 9/1992 |
| JP | 09-185970 | A | 7/1997 |
| JP | 2000-208200 | A | 7/2000 |
| JP | 2008-207572 | A | 9/2008 |

OTHER PUBLICATIONS

International Search Report for PCT/JP2011/052443 dated Mar. 1, 2011 [PCT/ISA/210].
Written Opinion for PCT/JP2011/052443 dated Mar. 1, 2011 [PCT/ISA/237].
Extended European Search Report, dated Jun. 6, 2013, issued by the European Patent Office in counterpart European Patent Application No. 11739895.8.

* cited by examiner

*Primary Examiner* — Truc Nguyen
(74) *Attorney, Agent, or Firm* — Sughrue Mion, PLLC

(57) ABSTRACT

A female terminal includes an electric contact portion that has a cylindrical box portion and an elastic contact spring disposed in the inner part of the box portion. An abutment portion of the metal plate is disposed on the upper wall portion of the box portion, and an indent is formed, from the outside of the box portion, at the upper wall portion having the abutment portion disposed thereon. A projection portion is provided at the inside of the box portion, and an apex of the projection portion is made to be a contact portion with respect to the male terminal.

2 Claims, 5 Drawing Sheets

FEMALE TERMINAL FOR CONNECTOR

CROSS REFERENCE TO RELATED APPLICATION

This application is a continuation of PCT application No. PCT/JP2011/052443, which was filed on Feb. 4, 2011 based on Japanese Patent Application (No. 2010-022858) filed on Feb. 4, 2010, the contents of which are incorporated herein by reference. Also, all the references cited herein are incorporated as a whole.

BACKGROUND

1. Technical Field

The present invention relates to a female terminal which is preferable for being used in a waterproof connector with a mat seal (also referred to as a waterproof rubber stopper).

2. Background Art

FIG. 5 is a schematic view showing an example of a waterproof connector with a mat seal described in JP-A-2000-208200.

The waterproof connector is configured such that a mat seal 120 made of a thick plate shaped elastic body (a rubber plate) is attached to a rear end of a connector housing 110, a mat seal cover 130 which is made of a hard resin and is adapted to press the mat seal 120, is attached to a rear side of the mat seal 120, and female terminals 140 are inserted into respective terminal containing chambers of the connector housing 110 through terminal insertion holes 122 of the mat seal 120 and through-holes 132 of the mat seal cover 130. After the terminals are inserted thereinto, an inner periphery lip of the terminal insertion holes 122 of the mat seal 120 are brought into intimate contact with outer peripheries of electric wires extending from the terminals, and thereby gaps between the electric wires and the connector housing 110 are sealed.

In those kinds of waterproof connectors, in general, a rectangular shaped female terminal of which, at a front portion, the box portion for receiving male terminals is formed in a rectangular cylindrical shape is usually used. However, in a case where the rectangular shaped female terminal is inserted into the circular terminal insertion hole 122 of the mat seal 120, the mat seal 120 is possibly scratched by a corner existing on the box portion.

With this, it is discussed that a circular female terminal of which the box portion is formed in a circular cylindrical shape is used. However, a problem may arise that the circular female terminal hardly ensures contact stability with a male terminal.

In passing, as a related example of a circular female terminal, one as shown in FIG. 6 is known. The female terminal 200 is described in JP-A-9-185970, and is formed of a terminal body 210 and a circular cylindrical sleeve 220 which is adapted to cover a front portion of the terminal body 210. A double forked spring piece 211 for receiving and clipping an inserted male terminal is provided at the front portion of the terminal body 210. An introduction portion 212 having a shape opened to the outside so as to readily receive the male terminal is formed on a tip portion of the double forked spring piece 211.

In the related female terminal 200 shown in FIG. 6, the double forked spring piece 211 is formed on the terminal body 210 so as to hold a male terminal of a mating connector therebetween, and it is necessary to fit, from the rear side, the sleeve 220 separately formed with the terminal body 210. Accordingly, while the contact stability with the male terminal can be improved, problems may arise that the structure is complicated (composed of two components) and the cost is increased.

SUMMARY

The invention is made in view of the above circumstances, and the purpose of the invention is to provide a female terminal for a connector which allows contact stability with a male terminal to be achieved, has a simple structure, has a box portion readily formed from one sheet of metal plate, and has a good insertion property with respect to a terminal insertion hole of a mat seal.

In order to achieve the above purpose, a female terminal for a connector according to a first aspect of the invention includes an electric contact portion that is disposed at a front side of the female terminal for electrically connecting a male terminal on a mating connector, and an electric wire connection portion that is disposed at a rear side of the female terminal for electrically connecting an electric wire. The electric contact portion includes a cylindrical box portion into which the male terminal is inserted through a front end inlet and an elastic contact spring which is provided in the box portion and is elastically deformed in a direction perpendicular to the insertion direction of the male terminal by being pushed by the male terminal when the male terminal is inserted into the box portion so as to hold the male terminal between the elastic contact spring and a peripheral wall of the box portion by an elastic reaction force caused by the elastic deformation. The box portion is made in a cylindrical shape formed in such a manner that a roughly rectangular shaped metal plate is rolled and end edges of the metal plate are abutted with each other. The elastic contact spring is formed by press processing a metal plate which is integrated with the metal plate from which the box portion is formed. In the peripheral wall of the box portion, an abutment portion in which the end edges of the metal plate are abutted with each other is disposed at a wall portion which holds the male terminal together with the elastic contact spring. A projection portion protruding toward the inside of the box portion is formed on the wall portion where the abutment portion is disposed, by press deforming the wall portion from the outside of the box portion in a concave shape. An apex of the projection portion serves as a contact portion with respect to the male terminal.

The terminal for a connector of a second aspect of the invention, is based on the female terminal for a connector according to the first aspect of the invention. The female terminal is a connector terminal which is inserted into a terminal insertion hole having a circular cross section formed on a mat seal attached to a rear end of a connector housing, thereby the connector terminal is accommodated in a terminal containing chamber.

In accordance with the first aspect of the invention, since the box portion is formed in a circular cylindrical shape, the female terminal can be readily inserted into the terminal insertion hole without scratching the mat seal.

In addition, in general, an abutment portion configured by end edges of a metal plate is disposed at an area while avoiding a part having an elastic contact spring or a wall portion for holding a male terminal between the abutment portion and the elastic contact spring. However, in the invention, the abutment portion of the metal plate is disposed on the wall portion for holding the male terminal between the abutment portion and the elastic contact spring, in the peripheral wall of the box portion. Further, the projection portion protruding toward the inside of the box portion is formed on the abutment portion by press deforming the wall portion in a concave shape from the outside of the box portion. Therefore, since the abutment portion tends to open in the press deforming, the contact portion (contact point) as the apex of the projection portion is divided into two points so that the male terminal is clipped and held by the two points together with a contact point at the elastic contact spring side, i.e., total three points. With this, the contact stability with the male terminal can be improved.

In a case where an abutment portion of a metal plate is not disposed at a wall portion for holding a male terminal between the abutment portion and an elastic contact spring and a projection portion is formed on a position of the wall portion at the inside by forming a concave from the outside as described above, an apex of the projection portion is not divided into two points but is concentrated at one point in a narrow range so that the male terminal is clipped and held by the point together with a contact point at an elastic contact spring side, i.e., total two points. Therefore, the male terminal is possibly rotated because of an instable holding posture. Consequently, the contact stability may be degraded with a high possibility. In this point, in accordance with the first aspect of the invention, it is possible to eliminate such instable holding and to improve the contact conductivity.

In addition, since the circular cylindrical box portion and the elastic contact spring can be made from an identical metal plate by press processing, it is possible to reduce the cost by simplifying the structure without using two components as in the related example shown in FIG. 6.

In accordance with the second aspect of the invention, the female terminal can be inserted into the terminal containing chamber of the connector housing through the terminal insertion hole of the mat seal without damaging the mat seal so that the waterproof connector having good quality can be assembled.

BRIEF DESCRIPTION OF THE DRAWINGS

FIG. 4A is a cross sectional view of the female terminal taken along a line of arrows B-B shown in FIG. 3, and FIG. 4B is a cross sectional view showing a state in which a male terminal is inserted into a female terminal not having an abutment portion at a part in which an indent is formed, as a comparison example with the female terminal according to the embodiment of the invention.

DETAILED DESCRIPTION OF THE EXEMPLARY EMBODIMENTS

An embodiment of the invention is described below with reference to accompanying drawings.

A female terminal according to the embodiment is inserted into a terminal insertion hole having a circular cross section on a mat seal attached to a rear end of a connector housing, and thereby the female terminal is formed to be a connector terminal suitable for being used in a waterproof connector.

Figure 1:
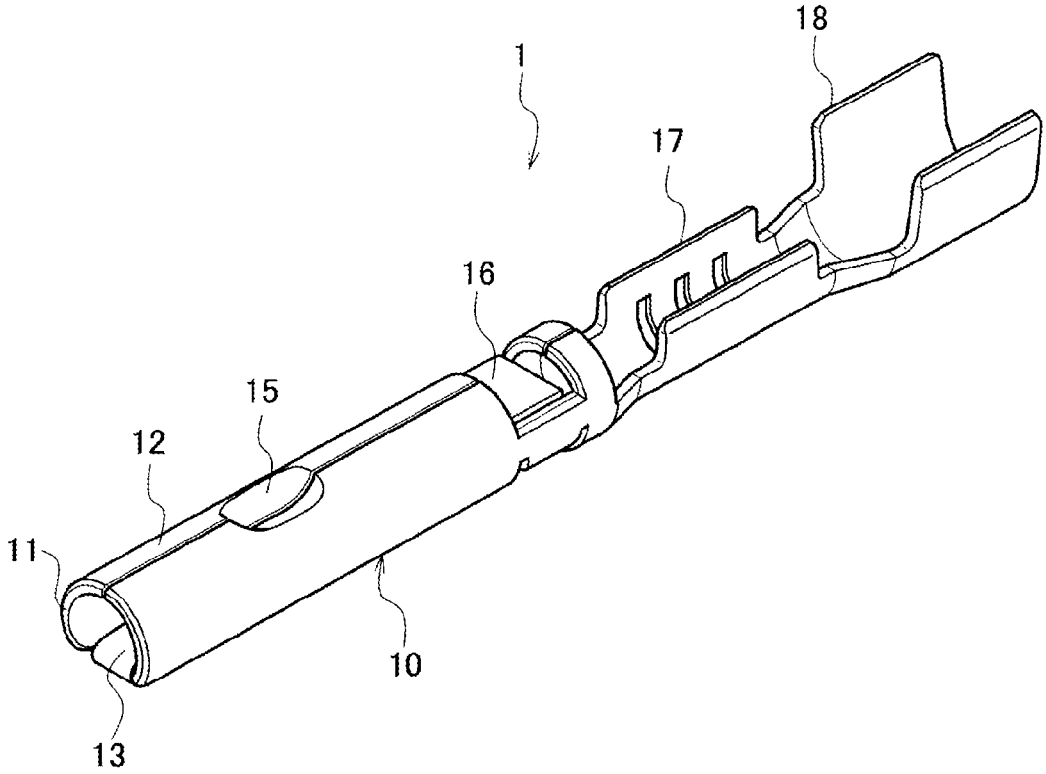
FIG. 1 is a perspective view showing a structure of a female terminal according to an embodiment of the invention.
Figure 2:
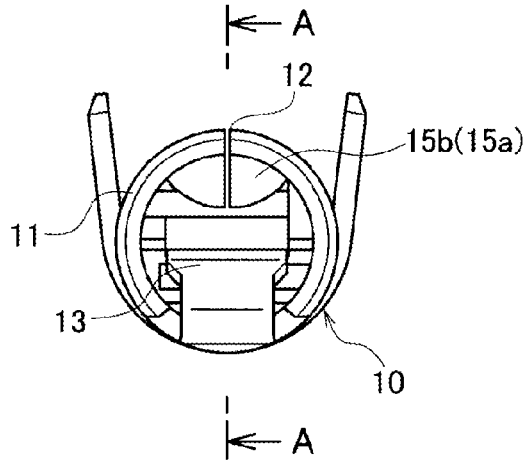
FIG. 2 is an enlarged view showing the female terminal shown in FIG. 1 from the anterior side.
Figure 3:
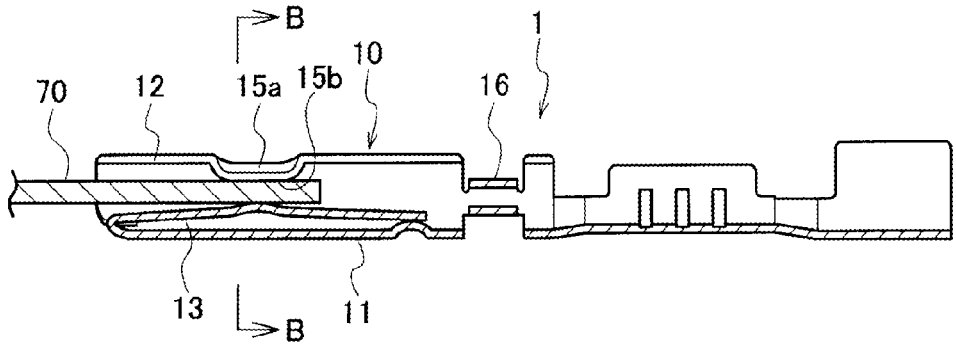
FIG. 3 is a cross sectional view showing the female terminal taken along a line of arrows A-A shown in FIG. 2 and showing a state in which a male terminal is inserted into the female terminal.
Figure 4A:
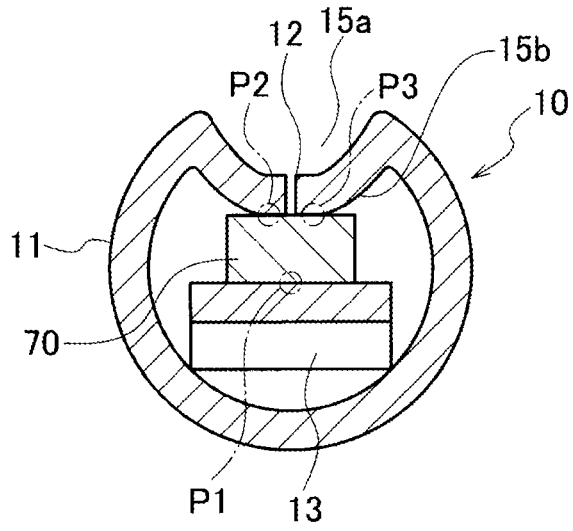
FIGS. 4A and 4B are cross sectional views showing the state in which the male terminal is inserted into the female terminal.
Figure 4B:
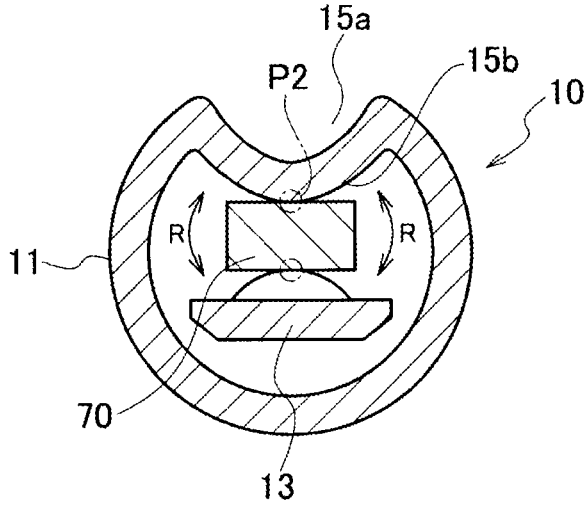
Figure 5:
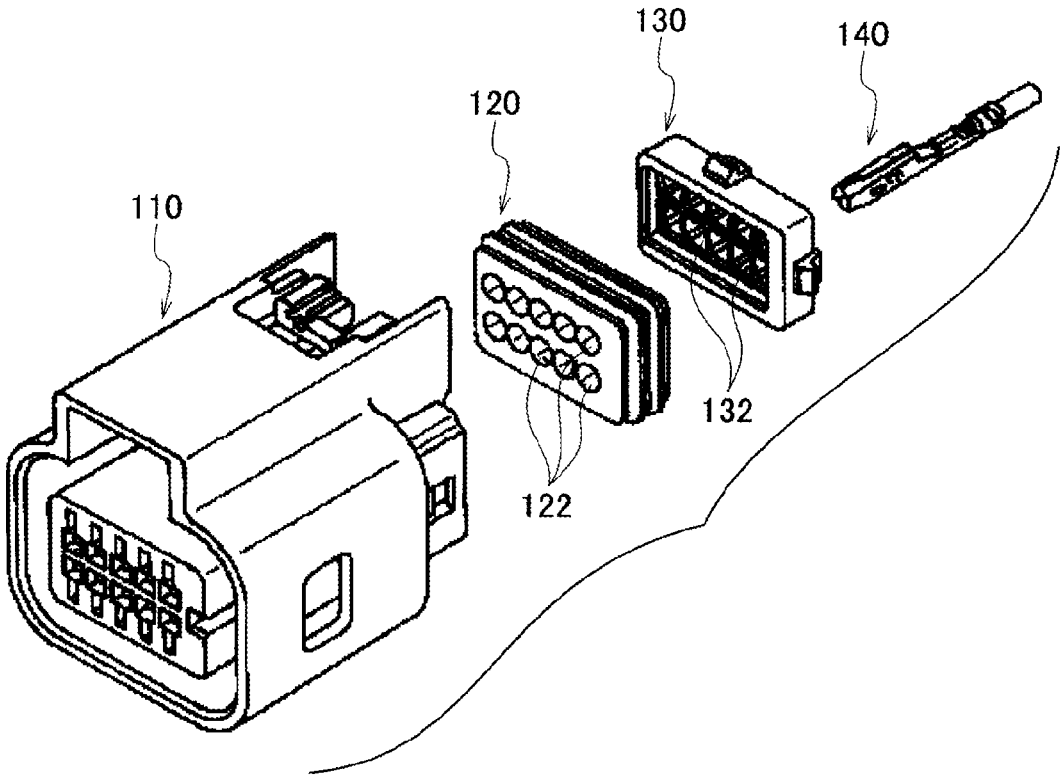
FIG. 5 is an exploded perspective view showing a related waterproof connector.

FIG. 1 is a perspective view showing a structure of the female terminal according to the embodiment. FIG. 2 is an enlarged view showing the female terminal from the anterior side. FIG. 3 is a cross sectional view showing the female terminal taken along a line of arrows A-A in FIG. 2 and showing a state in which a male terminal is inserted into the female terminal. FIG. 4A is a cross sectional view of the female terminal taken along a line of arrows B-B shown in FIG. 3, and FIG. 4B is a cross sectional view showing a state in which a male terminal is inserted into a female terminal not having an abutment portion at a part formed in which an indent is formed, as a comparison example with the female terminal according to the embodiment.

As shown in FIGS. 1 to 3, the female terminal 1 includes an electric contact portion 10 which is disposed at a front side thereof and is adapted to be electrically connected to a male terminal 70 on a mating connector, and a conductor crimping section 17 and a jacket connection section 18 which are disposed at a rear side thereof and are adapted to be connected to an electric wire. In addition, a positioning recessed portion 16 that positions and fixes the female terminal 1 when the female terminal 1 is inserted into the terminal containing chamber of the connector housing (not shown) is provided between the electric contact portion 10 and the conductor crimping section 17.

The electric contact portion 10 at the front side has a cylindrical box portion 11 into which the male terminal 70 (shown in FIG. 3) is inserted through a front end inlet, and an elastic contact spring 13 disposed in an inner part of the box portion 11.

In the above case, the box portion 11 is made in a cylindrical shape formed in such a manner that a roughly rectangular shaped metal plate is rolled and the end edges are abutted with each other.

In addition, when the male terminal 70 is inserted into the inner part of the box portion 11, the elastic contact spring 13 is elastically deformed by being pushed by the male terminal 70 in the downward direction perpendicular to the insertion direction of the male terminal 70, and the elastic contact spring 13 fulfills a function of clipping and holding the male terminal 70 between it and an upper wall portion in the peripheral wall of the box portion 11 by an elastic reactive force in the upward direction caused by the elastic deformation. The elastic contact spring 13 is formed in such a manner that a band plate extending at a tip portion of the roughly rectangular shaped metal plate constituting the box portion 11 is bent by press processing. That is, the elastic contact spring 13 is integrally formed with the box portion 11 from the identical plate material of the box portion 11.

An abutment portion 12 of the metal plate formed by rolling the metal plate in a cylindrical shape is disposed on the upper wall portion in the peripheral wall of the box portion 11 which holds the male terminal 70 between the abutment portion 12 and the elastic contact spring 13. A bowl shaped indent (a recessed portion by press deforming) 15*a* is formed on the upper wall portion where the abutment portion 12 is disposed, by press deforming the portion from the outside. As shown in FIG. 4A, by forming the indent 15*a* from the outside, a projection portion 15*b* protruding toward the inside of the box portion 11 is formed and an apex of the projection portion 15*b* becomes a contact portion to the male terminal 70.

Next, actions are described below.

Since the female terminal 1 is constituted such that the box portion 11 is formed in the circular cylindrical shape, the female terminal 1 can be readily inserted into the terminal containing chamber of the connector housing through the circular terminal insertion hole of the mat seal, and thereby a waterproof connector with good quality can be assembled.

In addition, in general, the abutment portion of the end edges of the metal plate is disposed at an area while avoiding a side having the elastic contact spring 13 or the upper wall portion which clips and holds the male terminal 70 between it and the elastic contact spring 13. However, in the female terminal 1 according to the embodiment, the abutment portion 12 of the metal plate is daringly disposed on the upper wall portion in the peripheral wall of the box portion 11 that clips and holds the male terminal 70 between it and the elastic contact spring 13. Further, the indent 15*a* is provided on the abutment portion 12 from the outside of the box portion 11 so as to form the projection portion 15*b* protruding toward the inside of the box portion 11. Therefore, since the abutment portion 12 tends to open in the press deforming as shown in FIG. 4A, the contact portion as the apex of the projection portion 15*b* is divided into two points P2 and P3 so that the male terminal 70 is clipped and held by the points P2, P3 together with a contact point P1 at the elastic contact spring 13 side, i.e., total three points P1, P2 and P3. With this, the contact stability with the male terminal 70 can be improved.

In passing, in a case where an abutment portion of the metal plate is not disposed at the upper wall portion for clipping and holding the male terminal 70 between it and the elastic contact spring 13 as shown in FIG. 4B and the projection portion 15*b* by the indent 15*a* as described above is formed on the position of the wall portion, the apex of the projection section 15*b* is not divided into two parts, but the contact point P2 is concentrated at one point in a narrow range so that the male terminal 70 is to be clipped and held by the contact point P2 together with the contact point P1 at the elastic contact spring 13 side, i.e., total two points P1 and P2. Therefore, the male terminal 70 is possibly rotated in the direction of arrow R because of an instable holding posture. Consequently, the contact stability may be degraded with a high possibility.

In the above point, in accordance with the female terminal 1 according to the embodiment, it is possible to eliminate such instable clipping and holding, and thereby to maintain the good contact conductivity.

Figure 6:
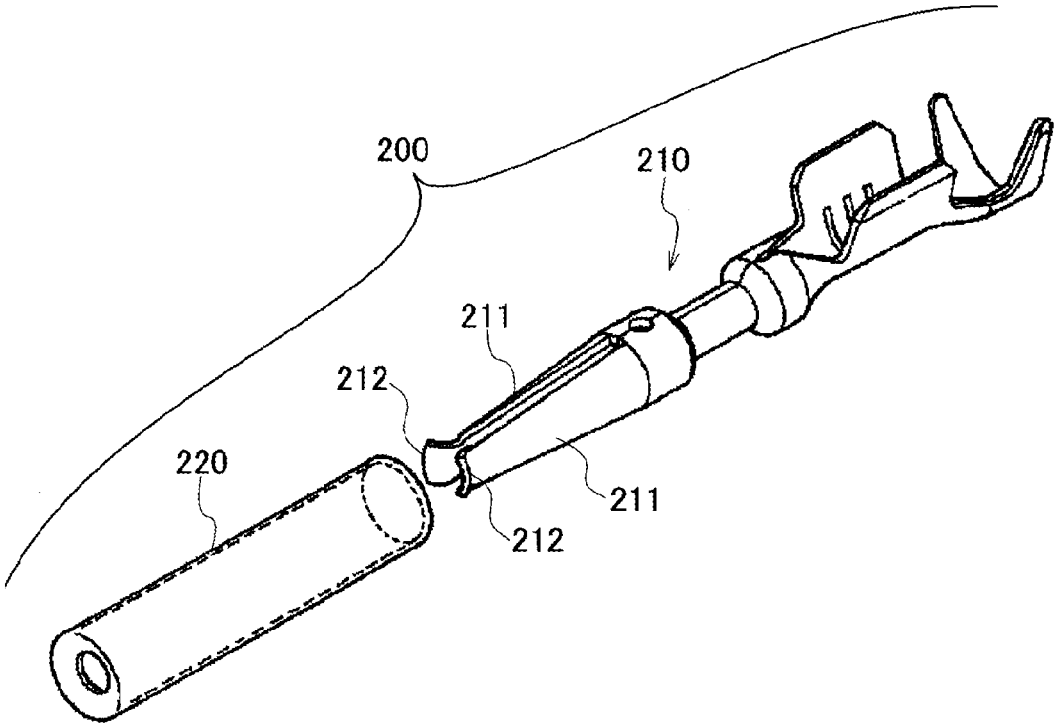
FIG. 6 is a perspective view showing an example of a related circular female terminal.

In addition, since the box portion 11 and the elastic contact spring 13 are made from the identical metal plate by press processing, it is not necessary to use two components as in the related example shown in FIG. 6, and thereby it is possible to reduce the cost by simplifying the structure.

While the invention is described in detail by referring to a specific embodiment, it is understood by those of ordinary skill in the art that various modifications and changes can be made without departing from the spirit and scope of the invention.

What is claimed is:

1. A female terminal for a connector comprising:

an electric contact portion that is disposed at a front side of the female terminal for electrically connecting a male terminal on a mating connector; and an electric wire connection portion that is disposed at a rear side of the female terminal for electrically connecting an electric wire, wherein the electric contact portion includes:

a cylindrical box portion into which the male terminal is inserted through a front end inlet; and an elastic contact spring which is provided in the box portion and is elastically deformed in a direction perpendicular to the insertion direction of the male terminal by being pushed by the male terminal when the male terminal is inserted into the box portion so as to hold the male terminal between the elastic contact spring and a peripheral wall of the box portion by an elastic reaction force caused by the elastic deformation;

wherein the box portion is made in a cylindrical shape formed in such a manner that a roughly rectangular shaped metal plate is rolled and end edges of the metal plate are abutted with each other;

wherein the elastic contact spring is formed by press processing a metal plate which is integrated with the metal plate from which the box portion is formed;

wherein in the peripheral wall of the box portion, an abutment portion in which the end edges of the metal plate are abutted with each other is disposed at a wall portion which holds the male terminal together with the elastic contact spring;

wherein a projection portion protruding toward the inside of the box portion is formed on the wall portion where the abutment portion is disposed, by press deforming the wall portion from the outside of the box portion in a concave shape; and wherein an apex of the projection portion serves as a contact portion with respect to the male terminal.

2. The female terminal according to claim 1, wherein the female terminal is a connector terminal which is inserted into a terminal insertion hole having a circular cross section formed on a mat seal attached to a rear end of a connector housing, so that the connector terminal is accommodated in a terminal containing chamber.

* * * * *